US008657282B2

(12) United States Patent
Hashimoto et al.

(10) Patent No.: US 8,657,282 B2
(45) Date of Patent: Feb. 25, 2014

(54) IMAGE FORMING DEVICE

(75) Inventors: Yohei Hashimoto, Aichi (JP); Hiroshi Nobe, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/483,583

(22) Filed: May 30, 2012

(65) Prior Publication Data

US 2013/0082433 A1 Apr. 4, 2013

(30) Foreign Application Priority Data

Sep. 30, 2011 (JP) ..... 2011-216046

(51) Int. Cl.
*B65H 29/00* (2006.01)

(52) U.S. Cl.
USPC ..... 271/186; 399/401

(58) Field of Classification Search
USPC ..... 271/65, 186, 185, 225, 291, 301, 162, 271/164, 258.05; 399/110, 124, 125, 107, 399/401, 21
See application file for complete search history.

(56) References Cited

U.S. PATENT DOCUMENTS

| | | | | |
|---|---|---|---|---|
| 2008/0175638 | A1* | 7/2008 | Murayama | 399/401 |
| 2010/0158596 | A1* | 6/2010 | Inoue | 399/401 |
| 2011/0262201 | A1* | 10/2011 | Souda | 399/401 |
| 2012/0228816 | A1* | 9/2012 | Tomatsu | 271/3.19 |

FOREIGN PATENT DOCUMENTS

| | | |
|---|---|---|
| JP | 06-055791 | 3/1994 |
| JP | 2001-171917 | 6/2001 |
| JP | 2009-179411 | 8/2009 |
| JP | 2011-032023 | 2/2011 |

* cited by examiner

*Primary Examiner* — Thomas Morrison
(74) *Attorney, Agent, or Firm* — Banner & Witcoff, Ltd.

(57) ABSTRACT

An image forming device, comprising: a device main body; a sheet cassette detachably attachable to a cassette accommodation space; an image formation unit; a re-carrying unit configured to re-carry the reversed sheet-like medium to the image formation unit and is exposed to the cassette accommodation space when the sheet cassette is detached; and a driving source supplying a driving force to the re-carrying unit, and wherein: the re-carrying unit comprises a driving roller and a pinch roller; a drive coupling mechanism having a transmission path transmitting the driving force to the driving roller is provided; the drive coupling mechanism comprises an acting part that brings the transmission path to a coupled state by moving in accordance with an attaching motion of the sheet cassette and brings the transmission path to a cut off state by moving in accordance with a detaching motion of the sheet cassette.

9 Claims, 7 Drawing Sheets

IMAGE FORMING DEVICE

CROSS-REFERENCE TO RELATED APPLICATION

This application claims priority under 35 U.S.C. §119 from Japanese Patent Application No. 2011-216046, filed on Sep. 30, 2011. The entire subject matter of the application is incorporated herein by reference.

BACKGROUND

1. Technical Field

Aspects of the present invention relate to an image forming device.

2. Related Art

Image forming devices configured to have a device main body, a paper supply tray, an image formation unit, a re-carrying unit and a driving source have been used. In the image forming device of this type, the paper supply tray, the image formation unit, the re-carrying unit and the driving source are provided in the device main body. The re-carrying unit is arranged under the paper supply tray. The re-carrying unit has a drive roller and a pinch roller which rotate while contacting with each other.

In the image forming device, a sheet of paper placed on the paper supply tray is carried, and an image is formed on the sheet of paper through the image formation unit. Then, in a state where the sheet of paper on which an image has been formed is reversed, the reversed sheet of paper is re-carried to the image formation unit while the reversed sheet of paper is nipped between the drive roller and the pinch roller.

SUMMARY

In the above described conventional image forming device, the paper supply tray is provided in a sheet cassette which is detachably attachable to a cassette accommodation space in the device main body. In this case, when paper jam occurs in the re-carrying unit, the sheet cassette is exposed to the outside by a user by detaching the sheet cassette from the cassette accommodation space so as to remove the jammed sheet of paper.

However, when the jammed sheet of paper is nipped by the drive roller and the pinch roller, a load tends to be placed on the jammed sheet of paper by the drive roller which is coupled to the driving source and is in a state of not being able to rotate freely. Therefore, the sheet of paper jammed in the re-carrying unit cannot be removed easily or the sheet of paper is damaged.

Aspects of the present invention are advantageous in that they provide an image forming device enabling a user to easily remove a sheet of paper jammed in a re-carrying unit.

According to an aspect of the invention, there is provided an image forming device, comprising: a device main body having a cassette accommodation space; a sheet cassette accommodating a sheet-like medium, the sheet cassette being detachably attachable to the cassette accommodation space; an image formation unit that is provided in the device main body and is configured to form an image on the sheet-like medium carried from the sheet cassette; a re-carrying unit that is located under the sheet cassette attached to the cassette accommodation space in the device main body and is configured to re-carry the sheet-like medium to the image formation unit in a state where the sheet-like medium whose one face has been subjected to image formation has been reversed, the re-carrying unit being exposed to the cassette accommodation space when the sheet cassette is detached from the cassette accommodation space; and a driving source that is provided in the device main body and supplies a driving force to the re-carrying unit. In this configuration, the re-carrying unit comprises a driving roller and a pinch roller that carry the revered sheet-like medium by rotating and contacting with each other via the sheet-like medium; a drive coupling mechanism having a transmission path transmitting the driving force of the driving source to the driving roller is provided between the driving source and the driving roller; the drive coupling mechanism comprises an acting part that brings the transmission path to a coupled state by moving in accordance with an attaching motion of the sheet cassette to the cassette accommodation space and brings the transmission path to a cut off state by moving in accordance with a detaching motion of the sheet cassette with respect to the cassette accommodation space.

BRIEF DESCRIPTION OF THE ACCOMPANYING DRAWINGS

DETAILED DESCRIPTION

Hereafter, embodiments according to the invention will be described with reference to the accompanying drawings.

First Embodiment

Figure 1:
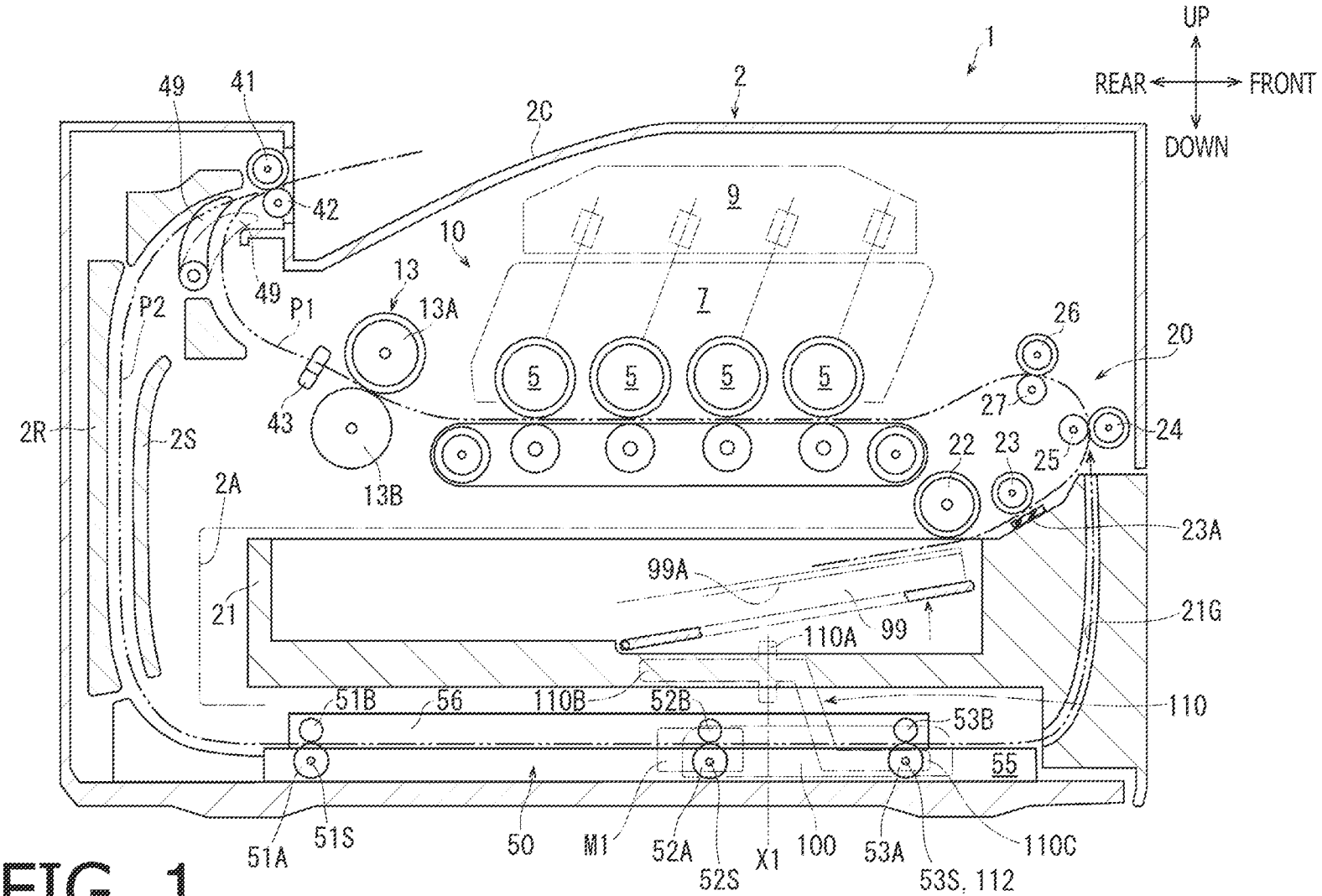
FIG. 1 is a cross sectional view generally illustrating an image forming device according to a first embodiment in a state where a sheet cassette is attached to the image forming device.

As shown in FIG. 1, a printer 1 according to a first embodiment which is an example of an image forming device is a color laser printer which is able to form a multicolor image on a sheet of paper 99 (i.e., an example of a sheet-like medium) through an electrophotographic process. In FIG. 1, the front and rear direction, the left and right direction and the vertical direction are represented by defining the right side on the paper face of FIG. 1 as a front side of the printer and defining the left hand side (the near side on the paper face of FIG. 1) of the printer viewed from the front side as a left side. All the directions defined in FIG. 1 also apply to the drawings from FIG. 2. In the following, components provided in the printer 1 are explained with reference to the accompanying drawings.

(Overall Configuration of Printer)

As shown in FIG. 1, the printer 1 includes a housing 2 having a box-shape, and a frame member (not shown) provided in the housing 2. The housing 2 and the frame member form a device main body of the printer 1.

Figure 2:
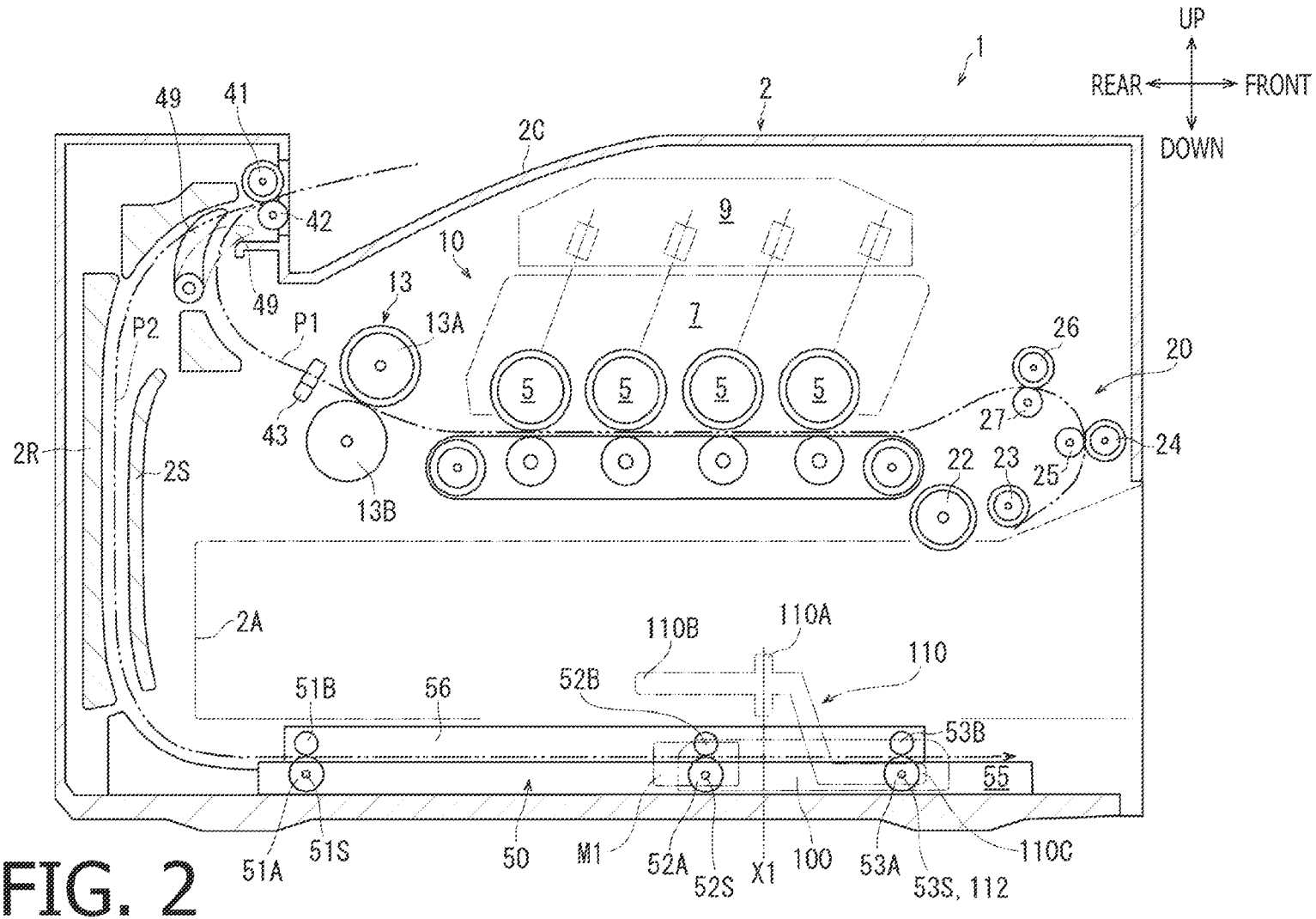
FIG. 2 is a cross sectional view generally illustrating the image forming device according to the first embodiment in a state where the sheet cassette is detached the image forming device.

As shown in FIGS. 1 and 2, a cassette accommodation space 2A is formed in the housing 2. The cassette accommodation space 2A is formed as an internal space which opens at a lower portion on the front side and which is formed as a recession to reach the vicinity of the rear side. In the cassette accommodation space 2A, a sheet cassette 21 is provided to be detachably attachable to the cassette accommodation space 2A.

The sheet cassette 21 is formed to be opened toward the upper side and is formed in a box-shape. The sheet cassette 21 accommodates a stack of sheets of paper 99. The sheet cassette 21 is inserted into the cassette accommodation space 2A from the front side of the printer 1, and is attached to the device main body by being pressed toward the rear side. Through the inverse operation, the sheet cassette 21 can be detached from the device main body.

Figure 3:
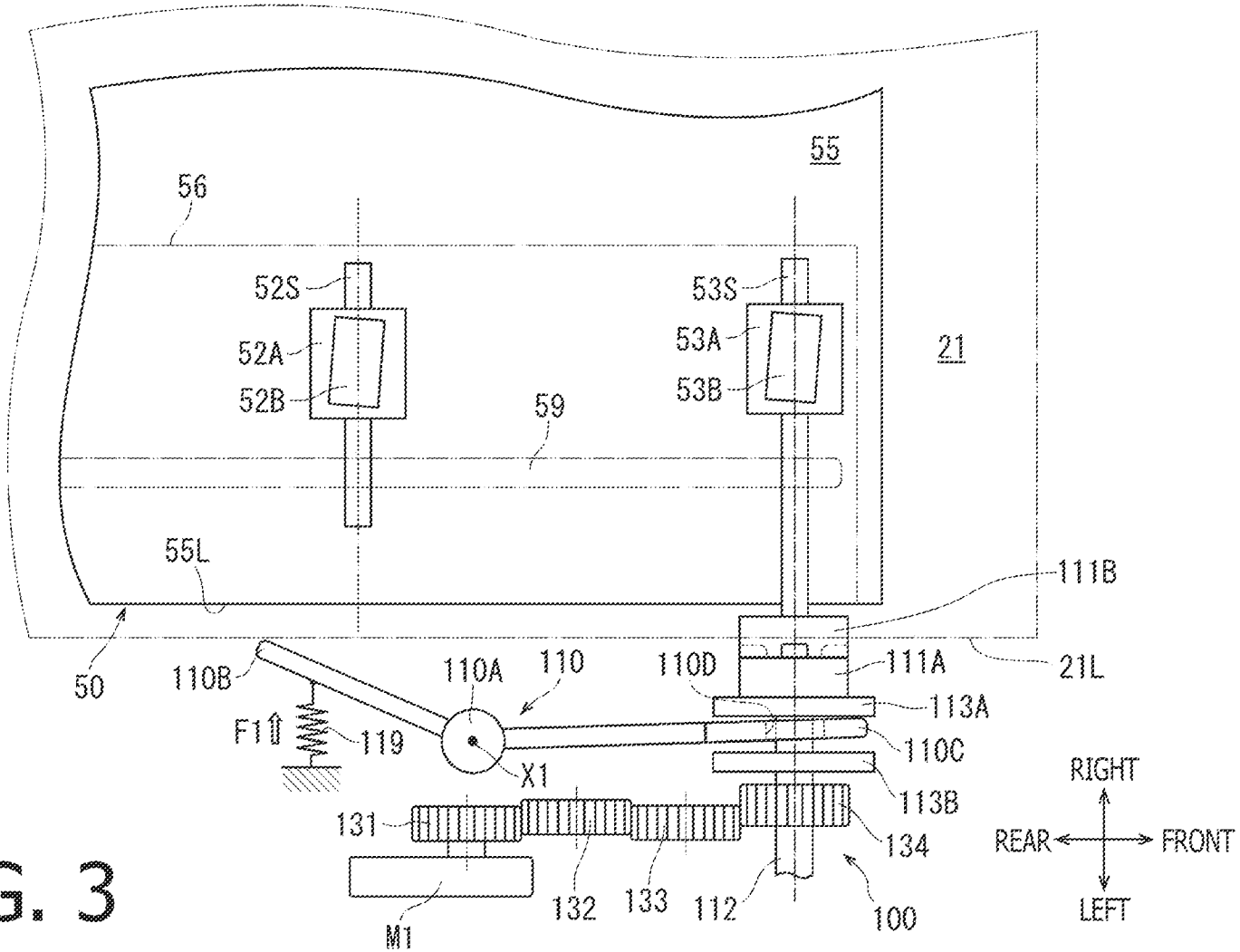
FIG. 3 is a schematic top view illustrating a re-carrying unit, a driving source and a drive coupling mechanism in the image forming device according to the first embodiment in a state where the sheet cassette is attached to the image forming device.

As shown in FIG. 1, in the housing 2, a paper supply unit 20, an image formation unit 10, and ejection rollers 41 and 42 are provided above the cassette accommodation space 2A and the sheet cassette 21. In the housing 2, a re-carrying unit 50 is provided under the cassette accommodation space 2A and sheet cassette 21. As shown in FIGS. 1 to 3, on the left side of the re-carrying unit in the housing 2, a driving source M1 and a drive coupling mechanism 100 are provided. Since, in FIGS. 1 and 2, the driving source M1 and the drive coupling mechanism 100 are on the near side on the paper face with respect to the re-carrying unit 50, the driving source M1 and the drive coupling mechanism 100 are illustrated by a double chain line. The paper supply unit 20, the image formation unit 10, the ejection rollers 41 and 43, the driving source M1 and the drive coupling mechanism 100 are attached to the frame member (not shown).

As shown in FIG. 1, on the top surface of the housing 2, an ejection tray 2C on which the sheet of paper P which has been subjected to the image formation is ejected is provided. In the housing 2, a carrying path P1 and a re-carrying path P2 are provided.

The carrying path P1 is formed to extend from the upper edge part of the front end of the sheet cassette 21, to turn through the paper supply unit 20, to extend in substantially the horizontal direction through the image formation unit 10, to turn again toward the front side, and then to reach the ejection tray 2C via the ejection rollers 41 and 42 located on the upper side.

The re-carrying path P2 is formed to extend from the ejection rollers 41 and 42 along first re-carrying guides 2R and 2S provided on the rear side of the housing 2, to extend to the front side via the re-carrying unit 50, and then to reach the paper supply unit 20 provided on the upper side via a second re-carrying guide 21G accommodated in the front end part of the sheet cassette 21.

The paper supply unit 20 sends the sheets of paper 99 accommodated in the sheet cassette 21 one by one to the carrying path P1 through a paper supply roller 22, a separation roller 23 and a separation pad 23A. Then, the paper supply unit 20 sends the sheet of paper 99 to the image formation unit 10 through carrying rollers 24 and 25 and registration rollers 26 and 27 provided at a portion where the carrying path P1 turns in a U-shape toward the rear side.

The image formation unit 10 is a so-called direct tandem type capable of forming a color image. The image formation unit 10 may have a know configuration where a process cartridge 7, a scanner unit 9 and a fixing unit 13 are provided. The process cartridge 7 supports four colors of toner including black, yellow, magenta and cyan, and is formed as an integrated unit of four cartridges. The process cartridge 7 has four photosensitive drums 5, development rollers (not shown), chargers and toner reservoirs provided for the respective colors. The scanner unit 9 includes a laser source, a polygonal mirror, an f-θ lens and a mirror. The scanner unit 9 emits laser beams from the upper side toward the photosensitive drums 5 in the process cartridge 7.

On the rear side of a heat roller 13A and a pressure roller 13B, an ejection sensor 43 is provided to face the carrying path P1. As the ejection sensor 43, a know sensor configured such that movement of an actuator which swings while contacting the sheet of paper 99 is detected by an optical sensor (e.g., a photo interrupter) may be employed. When the ejection sensor 43 detects the sheet of paper 99 passing through the fixing unit 13, a detection result of the ejection sensor 43 is transmitted to a control unit (not shown). Based on the detection result, the control unit controls various timings including activation and stopping of the above described components during image formation.

The image formation unit 10 forms an image on the sheet of paper 99 being carried along the carrying path P1 as explained below. Outer surfaces of the photosensitive drums are charged positively and uniformly by the respective chargers, and are exposed by the high speed scanning laser beams emitted from the scanner unit 9. As a result, an electrostatic latent image corresponding to an image to be formed on the sheet of paper 99 is formed on each of the outer surfaces of the photosensitive drums 5. Then, toner is supplied from the toner reservoir to the outer surface of each photosensitive drum 5 in accordance with the electrostatic latent image formed thereon. In a state where the sheet of paper 99 is accommodated in the sheet cassette 21, one face 99A of the sheet of paper 99 faces the lower side. When the sheet of paper 99 passes through the image formation unit 10 while being carried along the carrying path P1, the one face 99A faces the photosensitive drums 5 on the upper side. Then, the toner held on the outer surfaces of the photosensitive drums 5 is transferred to the one face 99A of the sheet of paper 99, and is heated and pressurized by the fixing unit 13. As a result, the toner is fixed on the sheet of paper 99.

The ejection rollers 41 and 42 are located at the most downstream part on the carrying path P1 and faces the ejection tray 2C. Under control of the control unit (not shown), the ejection roller 41 rotates in a normal direction or in an inverse direction. The ejection roller 42 rotates in accordance with rotation of the ejection roller 41 while being pressed against the ejection roller 41.

A flapper 49 is provided at the backward and lower portion of the ejection rollers 41 and 42 in the housing 2. The flapper 49 is supported on the frame member (not shown) such that a lower end of the flapper 49 is rotatable. Specifically, under control of the control unit (not shown), the flapper 49 rotates between a position indicated by a solid line and a position indicated by a double chain line. When the image formation is performed for the one face 99A of the sheet of paper 99, the flapper 49 is at the position indicated by a solid line to be along the carrying path P1. In this case, the flapper 49 guides the sheet of paper 99 being carried along the carrying path P1 so that the sheet of paper 99 is securely nipped by the ejection rollers 41 and 42.

By rotating the ejection roller 41 in the normal direction in a state where the ejection rollers nip the sheet of paper 99 which has passed the fixing unit 13, the sheet of paper 99 is ejected to the ejection tray 2C. Thus, the printer 1 finishes the image formation operation for the one face 99A of the sheet of paper 99.

(Re-Carrying Unit)

As explained below, the printer 1 is able to execute the image formation operation for the other face of the sheet of paper 99 by reversing the sheet of paper 99 whose one face 99A has been subjected to the image formation and by re-carrying the sheet of paper 99 to the image formation unit 10 via the re-carrying path P2.

The above described ejection rollers 41 and 42, the ejection sensor 43 and the flapper 49 serve also as a reversing mechanism, and reverses the sheet of paper 99 whose one face 99A has been subjected to the image formation as described below. That is, when a predetermined time has elapsed from a time when the ejection sensor 43 moves to a state of not detecting the trailing edge of the sheet of paper 99 during an ejection motion by the ejection rollers 41 and 42 nipping the sheet of paper 99, the control unit (not shown) switches rotation of the ejection roller 41 from the normal rotation to the inverse rotation. At the same time, the control unit causes the flapper 49 to swing to the position indicated by a double chain line. As a result, the upper edge part of the flapper 49 crosses over the carrying path P1 to be along the re-carrying path P2. Consequently, the sheet of paper 99 is sent out to the re-carrying path P2 by the ejection rollers 41 and 42 and the flapper 49. Then, the sheet of paper 99 is carried downward while being guided by the first re-carrying guides 2R and 2S, and reaches the re-carrying unit 50 located under the sheet cassette 21.

As shown in FIGS. 1 and 3, the re-carrying unit 50 includes a re-carrying main body 55, driving shafts 51S, 52S and 53S, driving rollers 51A, 52A and 53A, a nip roller support unit 56 and nip rollers 51B, 52B and 53B.

The re-carrying main body 55 is a tray-shaped member whose upper surface is formed to be a substantially horizontal flat and smooth surface. The upper surface of the re-carrying main body 55 extends to reach the lower edge of the second re-carrying guide 21G on the front side. By the upper surface of the re-carrying main body 55, the substantially horizontal part of the re-carrying path P2 is formed.

In this embodiment, the width direction of the sheet of paper 99 being re-carried corresponds to the left and right direction. The length of the re-carrying main body 55 in the left and right direction is larger than the length of the sheet of paper 99 in the left and right direction. That is, a left side surface 55L of the re-carrying main body 55 is located on the left side with respect to one edge in the width direction (i.e., the left edge) of the sheet of paper 99. The re-carrying main body 55 is attached to the bottom of the housing 2 with a fixing member (e.g., a screw), and therefore the re-carrying main body 55 can be detached from the housing 2 for a maintenance work.

Each of the driving shafts 51S, 52S and 53S is a column-like shaft body extending in the left and right direction, and is supported in the re-carrying main body 55 to be rotatable. The driving shafts 51S, 52S and 53S are arranged in this order along the substantially horizontal part of the re-carrying path P2 (i.e., from the rear side to the front side). As shown in FIG. 3, the drive shaft 53S extends toward the left side to be longer than the driving shafts 51S and 52S, and is formed to protrude to the left side with respect to the left side surface 55L of the re-carrying min body 55.

Figure 4:
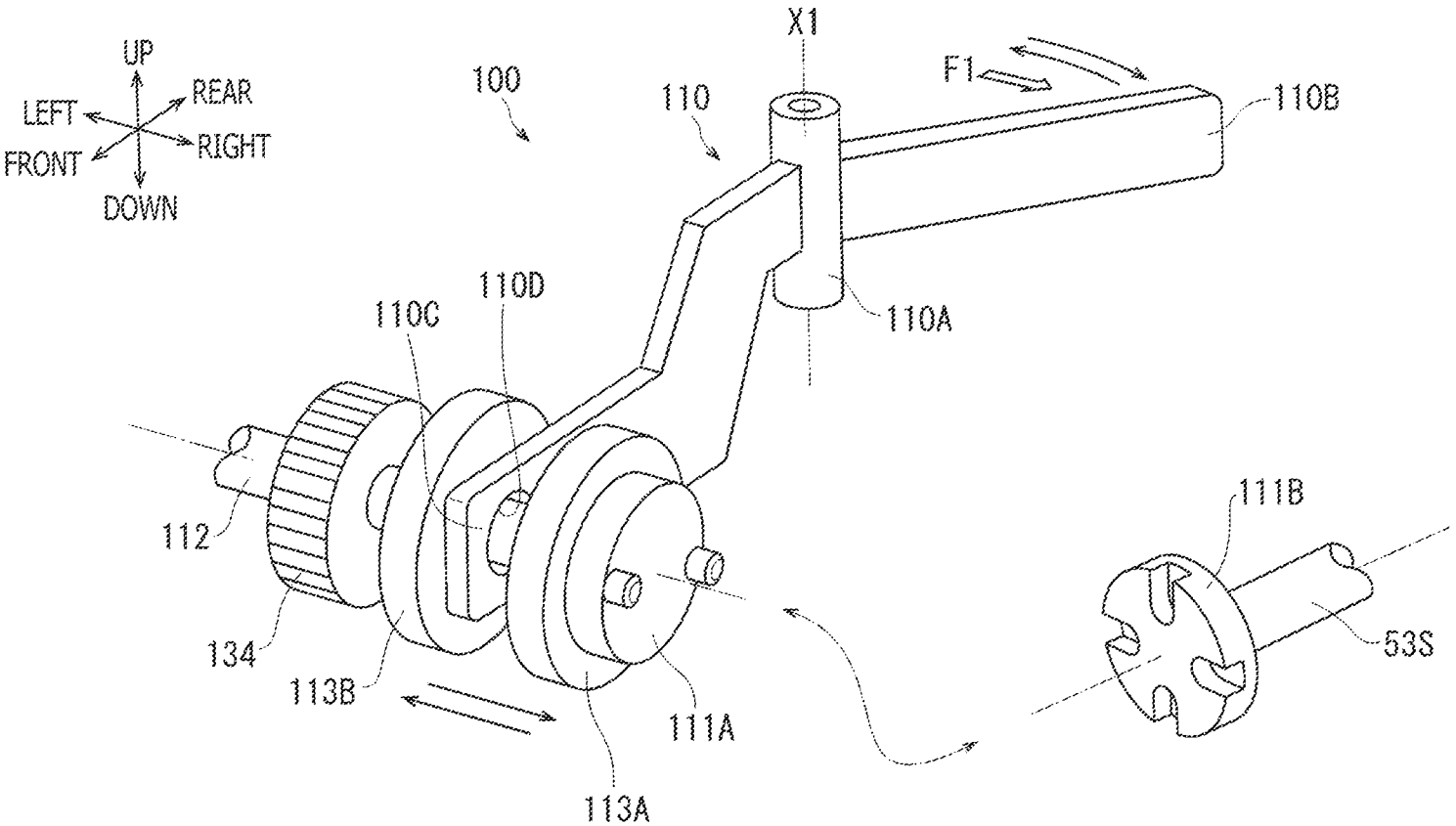
FIG. 4 is a perspective view illustrating components including an acting part, a coupling part, a coupled part and a driving shaft in the mage forming device according to the first embodiment.

As shown in FIGS. 3 and 4, at a left end of the driving shaft 53S, a coupled part 111B is fixed such that the coupled part 111B rotate together with the driving shaft 53S. The coupled part 111B is formed such that a plurality of recessions are formed on a circular plate thereof.

On the left side of the coupled part 111B, a transmission shaft 112 extending coaxially with the driving shaft 53S in the left and right direction is rotatably supported on the frame member (not shown). As shown in FIG. 4, the transmission shaft 112 is supported by the frame member to be movable in the left and right direction.

As shown in FIGS. 3 and 4, at a right end of the transmission shaft 112, a coupling part 111A is fixed such that the coupling part 11A rotates together with the transmission shaft 112, and the coupling part 111A faces the coupled part 111B in the left and right direction. The coupling part 111A is formed such that a plurality of projections are formed on a circular plate. The coupling part 111A and the coupled part 111B form a coupling which can be engaged or disengaged with respect to each other.

On the left side of the coupling part 111A of the transmission shaft 112, flange parts 113A and 113B are fixed such that the flange parts 113A and 113B rotate together with the transmission shaft 112. A space is formed between the flange parts 113A and 113B in the left and right direction.

On the left side of the flange part 113B of the transmission shaft 112, a transmission gear 134 is fixed such that the transmission gear 134 rotates together with the transmission shaft 112.

As shown in FIG. 3, the driving source M1 is an electric motor (which may have a known structure), and is arranged in the housing 2 so as to be spaced toward the left side from the left side surface 55L of the re-carrying main body 55. To an output shaft of the driving source M1 being oriented in the left and right direction, a transmission gear 131 is fixed such that the transmission gear 131 rotates together with the output shaft of the driving source M1. The transmission gear 131 is located on the rear side of the transmission gear 134. Transmission gears 132 and 133 intervene between the transmission gears 131 and 134.

As shown in FIGS. 3 and 4, an acting part 110 is provided between the left side surface 55L of the re-carrying main body 55 and the transmission gears 131 to 134. The acting part 110 includes an intermediate part 110A, an input part 110B and an output part 110C.

The intermediate part 110A has a cylindrical shape extending in the vertical direction. The intermediate part 110A is supported on the frame member to be able swing about a first swing axis X1 extending in the vertical direction perpendicular to the driving shaft 53S. The input part 110B has a shape of a slender plate extending from the intermediate part 110A to the rear side. The output part 110C has a shape of a slender plate extending from the intermediate part 110A to the front side. In addition, the output part 110C is formed to bend downward in a shape of a crank.

When viewed along the left and right direction as shown in FIG. 1, the intermediate part 110A and the input part 110B are arranged at the positions overlapping with the sheet cassette 21. Furthermore, the intermediate part 110A is located on the rear side with respect to the transmission shaft 112, and the input part 110B is located on the further rear side with respect to the transmission shaft 112 (i.e., on the rear side of the intermediate part 110A). On the other hand, the front end part of the output part 110C is formed to reach the position overlapping with the transmission shaft 112.

As shown in FIG. 3, when viewed from the upper side, the rear side part of the input part 110B shifts rightward with respect to the intermediate part 110A so as to approach the sheet cassette 21. On the other hand, the front side part of the output 110C extends substantially straight from the intermediate part 110A, and is sandwiched between the flange parts 113A and 113B in the left and right direction.

As shown in FIGS. 3 and 4, a through hole 110D is formed in the front end part of the output 110C, and the transmission shaft 112 penetrates through the through hole 110D.

As shown in FIG. 3, a pressing member 119 (e.g., a compression coil spring) is provided between the input part 110B and an internal frame (not shown). The pressing member 110 produces a pressing force F1 for moving the input part 110B to the right side.

In the case where the sheet cassette 21 is attached to the cassette accommodation space 2A, the input part 110B is held in a condition where the rear end of the input part 110B is pressed against a left side surface 21L of the sheet cassette 21. In this case, the front side part of the output 110C contacts the right flange part 113A so that the transmission shaft 112 is held in a state where the transmission shaft 112 shifts rightward. In this state, the coupling part 111A and the coupled part 111B are positioned to be close to each other, and the projections of the coupling part 111A fit into the recessions of the coupled part 111B. As a result, the transmission shaft 112 and the driving shaft 53S become able to rotate together via the coupling part 111A and the coupled part 111B.

Figure 5:
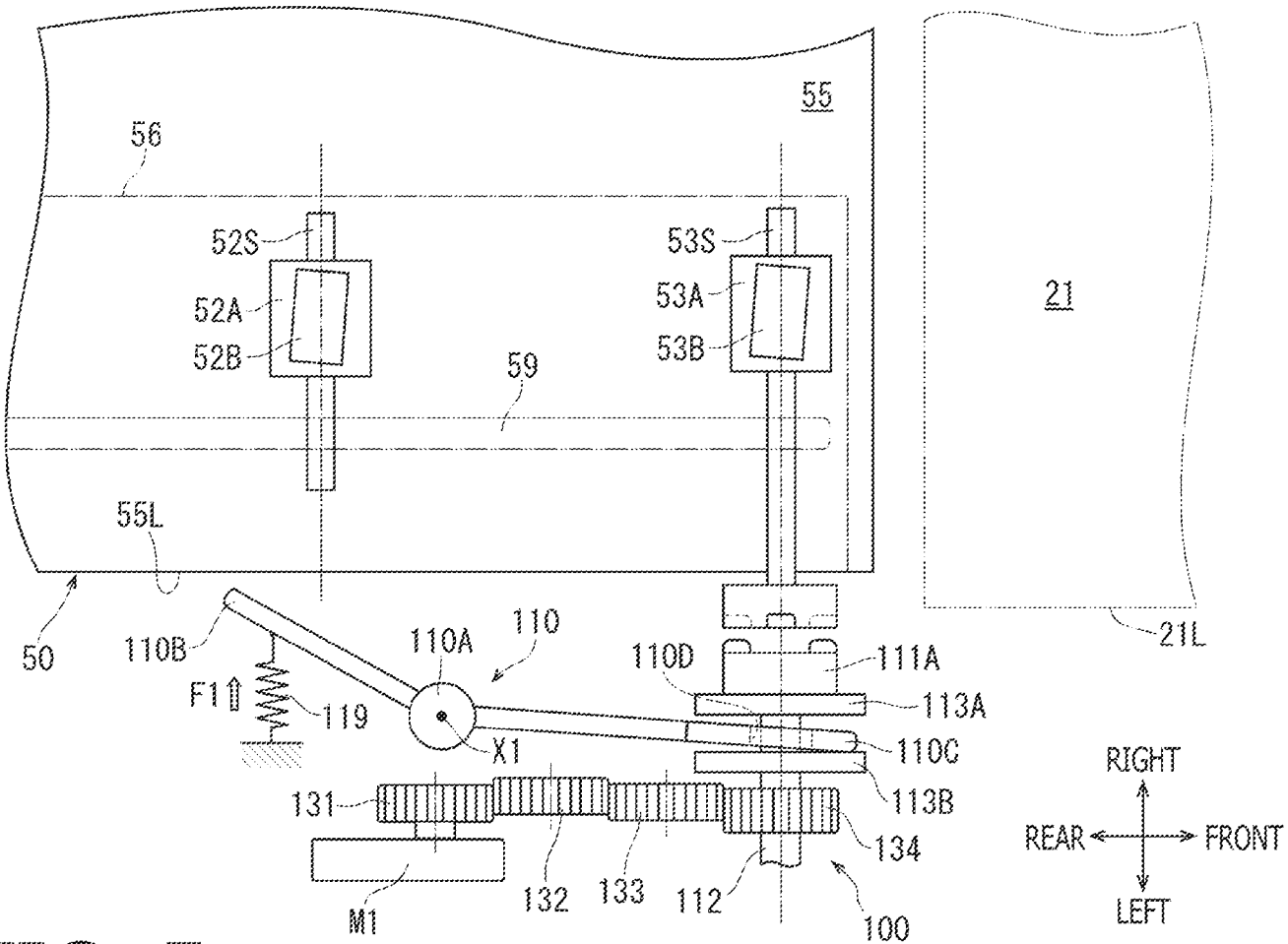
FIG. 5 is a schematic top view illustrating the re-carrying unit, the driving source and the drive coupling mechanism in the image forming device according to the first embodiment in a state where the sheet cassette is detached from the image forming device.

On the other hand, in the case where the sheet cassette 21 is detached from the cassette accommodation space 2A as shown in FIG. 5, the acting part 110 swings about the first swing axis X1 due to the pressing force F1 of the pressing member 119, and as a result the rear end of the input part 110B moves rightward from the position shown in FIG. 3. In this case, the front end part of the output part 110C moves leftward and contacts the left flange part 113B. As a result, the transmission shaft 112 is held in a state where the transmission shaft 112 is shifted leftward. In this state, the coupling part 111A and the coupled part 111B deviate from each other, and as a result the transmission shaft 112 rotates independently of the driving shaft 53S.

As shown in FIG. 3, when the detached sheet cassette 21 is attached to the cassette accommodation space 2A, the rear end of the input part 110B contacts the left side surface 21L of the sheet cassette 21 and moves leftward while resisting the pressing force F1. As a result, the input part 110B is held in a state where the rear end of the input part 110B is pressed against the left side surface 21L of the sheet cassette 21. Consequently, the coupling part 111A and the coupled part 111B engage with each other, and the transmission shaft 112 and the driving shaft 53S are restored to a state of being able to rotate together.

In the re-carrying main body 55, a rotation transmission unit 59 which causes the driving shafts 51S, 52S and 53S to rotate in synchronization with each other by transiting rotation of the driving shaft 53S to the driving shafts 51S and 52S is provided. For example, as the rotation transmission unit 59, a configuration having pulleys respectively fixed to the driving shafts 51S, 52S and 53S to be able to rotate together with the driving shafts 51S, 52S and 52S and having a belt wound around the pulleys may be employed.

As shown in FIGS. 1 and 3, the driving rollers 51A, 52A and 53A are respectively fixed to the driving shafts 51S, 52S and 53S to be able to rotate together with the driving shafts 51S, 52S and 53S. As shown in FIG. 3, the driving rollers 51A, 52A and 53A are arranged to be shifted to the left side surface 55L side of the re-carrying main body 55. Furthermore, as shown in FIG. 1, the tops of the outer circumferential surfaces of the driving rollers 51A, 52A and 53A slightly project upward from the top surface of the re-carrying main body 55. With this configuration, the driving rollers 51A, 52A and 53A are able to contact the left edge part of the sheet of paper 99 passing above the re-carrying main body 55.

As shown in a simplified manner in FIGS. 1 and 3, the nip roller support unit 56 is formed to stand upward from the left side surface 55L of the re-carrying main body 55, to extend to the right side of the re-carrying main body 55 while keeping a space with respect to the top surface of the re-carrying main body 55, and thereby to cover the driving rollers 51A, 52A and 53A from the upper side. That is, the top surface of the re-carrying main body 55 is covered with the nip roller support unit 56 in a region from the left side surface 55L to the vicinity of the driving rollers 51A, 52A and 53A, while the other region of the top surface of the re-carrying main body 55 is not covered with the nip roller support unit 56. Therefore, in the state where the sheet cassette 21 is detached from the cassette accommodation space 2A, the region of the top surface of the re-carrying main body 55 not covered with the nip roller support unit 56 is exposed to the cassette accommodation space 2A.

The nip rollers 51B, 52B and 53B are rotatably supported by the nip roller support unit 56. The nip rollers 51B, 52B and 53B respectively contact the driving rollers 51A, 52A and 53A from the upper side. Furthermore, the nip rollers 51B, 52B and 53B are respectively pressed against the driving rollers 51A, 52A and 53A by pressing springs (not shown). Left ends of the nip rollers 51B, 52B and 53B are shifted to the rear side with respect to the left ends of the driving rollers 51A, 52A and 53A. With this configuration, the nip rollers 51B, 52B and 53B respectively rotate in accordance with rotation of the driving rollers 51A, 52A and 53A in a state where the nip rollers 51B, 52B and 53B are respectively inclined with respect to the driving rollers 51A, 52A and 53A.

A portion from the transmission gear 131 to the driving shafts 51S to 53S is a transmission path for transmitting a driving force of the driving source M1 to the driving rollers 51A to 53A. Thus, the drive coupling mechanism 100 is constituted by the transmission gears 131 to 134, the transmission shaft 112, the coupling part 111A, the coupled part 111B, the driving shaft 53S, the rotation transmission unit 59 and the driving shafts 51S and 52S which form the transmission path, and the acting part 110 and the pressing member 119 which switch the transmission path between a coupled state and a cut off state.

When the sheet of paper 99 being re-carried reaches the re-carrying unit 55, the sheet of paper 99 is nipped by the driving rollers 51A, 52A and 53A and the nip rollers 51S, 52S and 53S in the state where the one face 99 faces upward. Since the input part 110B is held in the state where the rear end of the input part 110B contacts the left side face 21L of the sheet cassette 21, the front end of the output part 110C moves the transmission shaft 112 rightward so as to cause the coupling part 111A to engage with the coupled part 111B. As a result, the transmission path from the transmission gear 131 to the driving shafts 51S to 53S is in the coupled state.

Therefore, the driving force from the driving source M1 is transmitted to the driving rollers 51A, 52A and 53A, and thereby the driving rollers 51A, 52A and 53A rotate in synchronization with each other. As a result, the sheet of paper 99 being nipped by the driving rollers 51A, 52A and 53A and the nip rollers 51B, 52B and 53B is carried along the re-carrying path P2 while sliding on the top surface of the re-carrying unit 50. In this case, the sheet of paper 99 is moved to the left side by the inclined nip rollers 51B, 52B and 53B, and thereby the left edge of the sheet of paper 99 contacts a guide (not shown) and the sheet of paper P is registered in the left and right direction.

Thereafter, the sheet of paper 99 being re-carried is re-carried to the image formation unit 10 while passing through the second re-carrying guide 21G and the paper supply unit 20. In this case, since the sheet of paper 99 passes through the image formation unit 10 in the state where the other face the sheet of paper 99 (i.e., the opposite side of the one face 99A) faces upward by making a U-turn, an image is formed on the face opposite to the one face 99A of the sheet of paper 99. As a result, the sheet of paper 99 for which the image formation has been performed on both sides thereof is ejected to the ejection tray 2C by the ejection rollers 41 and 42.

(Advantages)

There is a case where, when the image formation is performed on both sides of the sheet of paper 99, the sheet of paper 99 being carried along the re-carrying path P2 jams in the re-carrying unit 50. In this case, in order to remove the jammed sheet of paper 99, a user detaches the sheet cassette 21 from the cassette accommodation space 2A so as to expose the re-carrying unit 50 to the cassette accommodation space 2A. Then, the user inserts the user's hand into the cassette accommodation space 2A, nips the sheet of paper 99 on the re-carrying main body 50, and draws the sheet of paper 99. Thus, the sheet of paper 99 can be removed.

As shown in FIG. 5, in the state where the sheet cassette 21 is removed from the cassette accommodation space 2A, the rear end of the input part 110B departs from the left side surface 21L of the sheet cassette 21, and moves rightward due to the pressing force F1 from the pressing member 119. Therefore, the front end of the output part 110C moves the transmission shaft 112 leftward, and causes the coupling parts 111A and 111B depart from each other. As a result, the transmission path defined from the transmission gear 131 to the driving shafts 51S to 53S is brought to the cut off state between the transmission shaft 112 and the driving shaft 53S. Consequently, the transmission shaft 112 rotates independently of the driving shaft 53S.

Therefore, even when the sheet of paper 99 is nipped by the driving rollers 51A to 53A and the pinch rollers 51B to 53B, the driving rollers 51A to 53A are able to rotate independently of the driving source M1. As a result, when the sheet of paper 99 is drawn, a load is hard to be applied to the sheet of paper 99. Consequently, the sheet of paper 99 jammed in the re-carrying unit 50 becomes easy to be removed, and in this case the sheet of paper 99 is hard to be damaged.

Therefore, according to the configuration of the printer 1 of the first embodiment, the sheet of paper 99 jammed in the re-carrying unit 50 can be easily removed.

In the state where the rear end of the input part 110B contacts the left side surface 21L of the sheet cassette 21 attached to the cassette accommodation space 2A and thereby moves to the left side, the rear end of the input part 110B is pressed against the left side surface 21L by the pressing force F1 from the pressing member 110 and thereby the swinging motion of the acting part 110 is fixed. As a result, the transmission path is securely held in the coupled state. On the other hand, in the state where the rear end of the input part 110B departs from the left side surface 21L of the sheet cassette 21 being removed from the cassette accommodation space 2A and thereby moves rightward, the front end of the output part 110C is pressed against the flange part 113B by the pressing force from the pressing member 119 and thereby the swinging motion of the acting part 110 is fixed. As a result, the transmission path is securely held in the cut off state. As described above, by providing the pressing member 119, the printer 1 is able to securely hold each of the coupled state and the cut off state.

Furthermore, in the printer 1, the driving roller 53A has the driving shaft 53S which extends to the left edge of the sheet of paper 99 being re-carried, and projects to the left side from the left side surface 55L of the re-carrying main body 55. The drive coupling mechanism 100 is located on the left side with respect to the left side surface 55L of the re-carrying unit 55, and is coupled to the driving shaft 53S. With this configuration, the drive coupling mechanism 100 is hard to interfere with the other components in the printer 1 in comparison with the case where a drive coupling mechanism is located in the central part of the housing 2.

According to the configuration of the printer 1, by the swinging motion of the acting part 110 around the first swing axis X1, the coupling part 111A reciprocates in the left and right direction which is parallel with the driving shaft 53S, and thereby the transmission path switches between the coupled state and the cut off state. As a result, the drive coupling mechanism 100 becomes able to smoothly transmit the driving force of the driving source M1 to components other than the driving rollers 51A to 53A. Specifically, a transmission gear which is able to distribute the driving force of the driving source M1 to the other components by engaging with one of the transmission gears 131 to 134 may be provided. In this case, by causing the transmission path to switch between the coupled state and the cut off state, it is possible to distribute the driving force of the driving source M1 to another component concurrently with the driving rollers 51A to 53A or independently of the driving rollers 51A to 53A. As a result, the design freedom of the printer 1 in regard to distribution of the driving force can be enhanced.

Since the coupling part 111A and the coupled part 111B are coupled in the printer 1, simplification of structure and shape of components can be achieved, and as a result the manufacturing cost can be decreased.

According to the configuration of the printer 1, the acting part 110 swings around the first swing axis X1 extending in the vertical direction which is perpendicular to the driving shaft 53S. Therefore, the coupling part 111A can be easily moved to reciprocate in the direction parallel with the driving shaft 53S.

Second Embodiment

Figure 6:
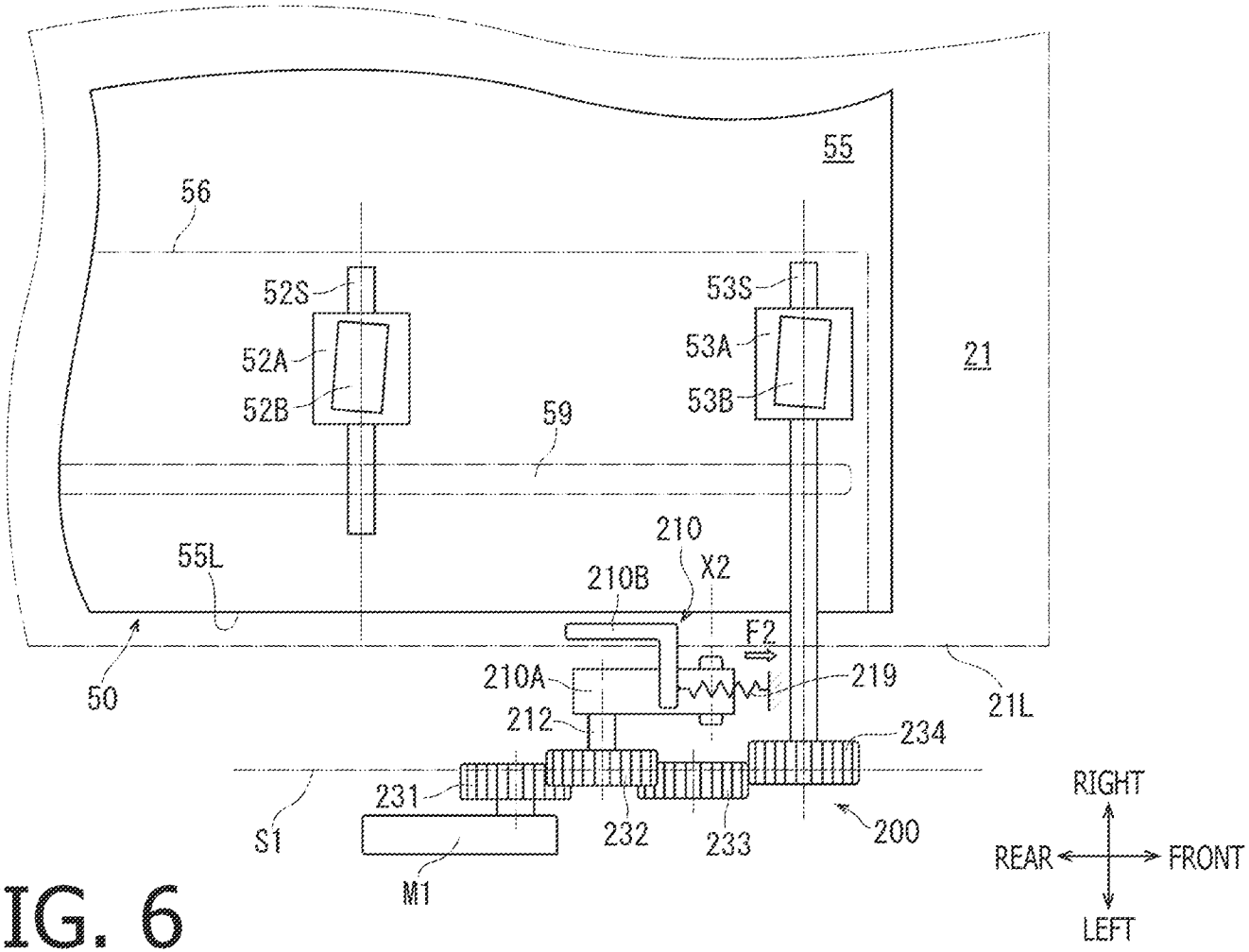
FIG. 6 is a schematic top view illustrating a re-carrying unit, a driving source and a drive coupling mechanism in an image forming device according to a second embodiment in a state where a sheet cassette is attached to the image forming device.
Figure 7:
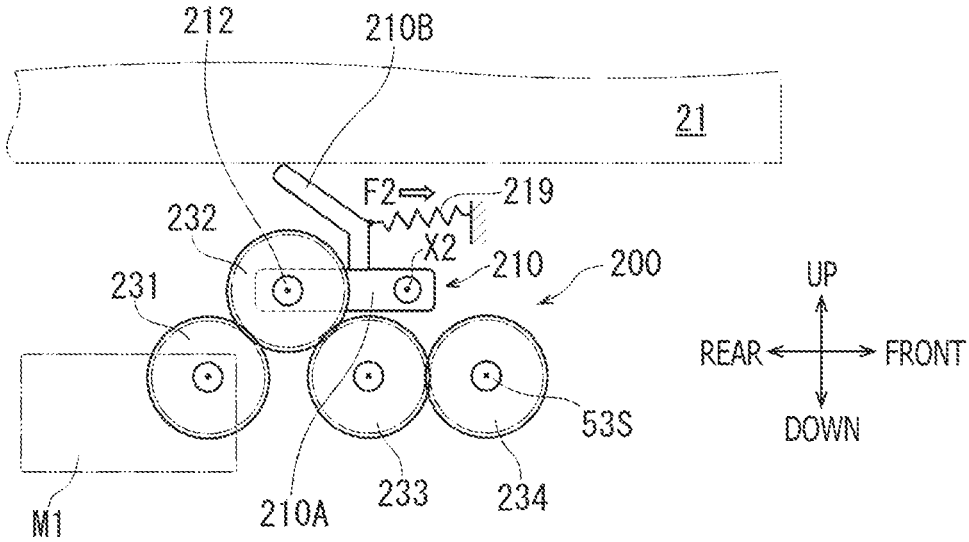
FIG. 7 is a schematic side view illustrating the driving source and the drive coupling mechanism in the image forming device according to the second embodiment in a state where the sheet cassette is attached to the image forming device.
Figure 8:
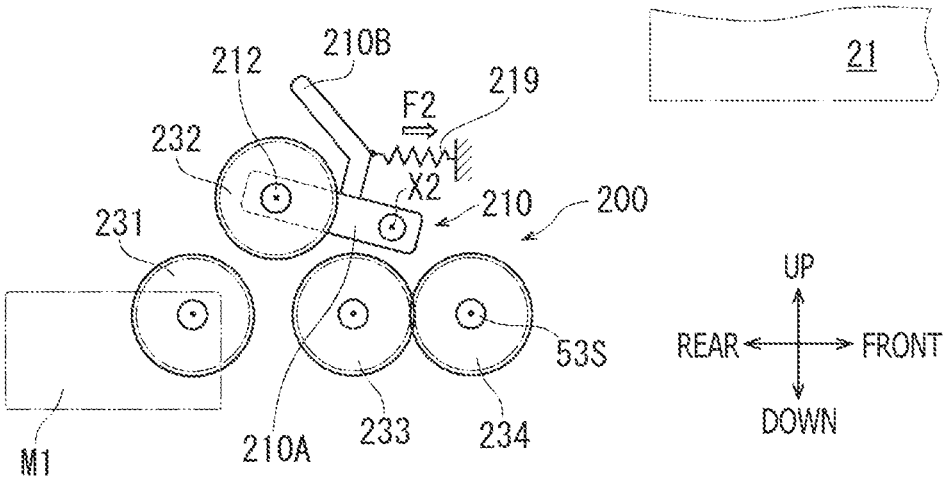
FIG. 8 is a schematic side view illustrating the driving source and the drive coupling mechanism in the image forming device according to the second embodiment in a state where the sheet cassette is detached from the image forming device.

A printer according to a second embodiment employs a drive coupling mechanism 200 shown in FIGS. 6 to 8 in place of the drive coupling mechanism 100 in the printer 1 according to the first embodiment. Other configurations in the second embodiment are substantially the same as those of the first embodiment. Therefore, to elements which are substantially the same as those of the first embodiment, the same reference numbers are assigned, and explanations thereof will not be repeated.

As shown in FIGS. 6 and 7, a transmission gear 234 is fixed to the left end of the driving shaft 53S such that the transmission gear 234 is able to rotate together with the driving shaft 53S. A transmission gear 231 fixed to the output shaft of the driving source M1 to be rotatable together with the output shaft of the driving source M1 is located on the rear side of the transmission gear 234. Transmission gears 232 and 233 intervene between the transmission gear 231 and the transmission gear 234. The transmission gear 232 is provided to be able to rotate about a rotation shaft 212 which is parallel with the driving shaft 53S. The transmission gear 233 is also provided to be able to rotate about a rotation shaft which is parallel with the driving shaft 53S. As shown in FIG. 6, the transmission gears 232 and 233 are arranged on a plane 51 which is perpendicular to the driving shaft 53S, and engage with the transmission gear 231 on the driving source M1 side and the transmission gear 234.

Between the left side surface 55L of the re-carrying main body 55 and the transmission gears 231 to 234, an acting part 210 is provided. The acting part 210 has a main body part 210A and an input part 210B.

The main body part 210A is a column-like member extending long in the front and rear direction. The front end of the main body part 210A is supported by a frame member (not shown) to be able to swing around a second swing axis X2 extending in the left and right direction which is parallel with the driving shaft 53S. On the other hand, the rear end of the main body part 210A supports the right end of the rotation shaft 212. That is, the rotation shaft 212 and the transmission gear 232 are supported by the main body part 210A so as to be able to swing around the second swing axis X2 as shown in FIGS. 7 and 8.

The input part 210B is formed to protrude from an intermediate part of the upper surface of the main body part 210A in the front and rear direction, to extend on the upper and right side, and then to bend upwardly to the rear side in a slanting direction.

As shown in FIG. 7, when viewed along the left and right direction, the second swing axis X2 and the main body part 210A are located on the upper side with respect to the transmission gears 231, 233 and 234. The input part 210B extends to the sheet cassette 21 on the upper side from the main body part 210A.

As shown in FIG. 6, when looking down from the upper side, the upper end part of the input part 210B is located on the right side with respect to the left side surface 21L of the sheet cassette 21.

As shown in FIGS. 6 and 7, a pressing member 219 which is a tensile coil spring is provided between the intermediate part in the vertical direction of the input part 210B and the internal frame (not shown), The pressing member 210 produces a pressing force F2 for pressing the upper end part of the input part 210B to move upward.

In the case where the sheet cassette 21 is attached to the cassette accommodation space 2A, the input part 210B is held in the state where the upper end part of the input part 210B is pressed against the lower surface of the sheet cassette 21 by the pressing force F2 of the pressing member 219. In this case, the acting part 210 swings around the second swing axis X2, and thereby the rear end part of the main body part 210A moves downward. As a result, the transmission gear 232 supported by the rotation shaft 212 moves downward along the plane S1 which is perpendicular to the driving shaft 53S, and is held in the state where the transmission gear 232 engages with the transmission gears 231 and 233. In this state, the driving force of the driving source M1 is transmitted to the driving shaft 53S via the transmission gears 231 to 234.

On the other hand, as shown in FIG. 8, in the case where the sheet cassette 21 is removed from the cassette accommodation space 2A, the upper end part of the input part 210B moves upward from the state shown in FIG. 7 by the pressing force F2 of the pressing member 219. In this case, the acting part 210 swings in the reverse direction around the second swing axis X2, and thereby the rear end part of the main body part 210A moves upward. As a result, the transmission gear 232 supported by the rotation shaft 212 moves upward along the plane S1 which is perpendicular to the driving shaft 53S, and thereby the transmission gear 232 is held in the state where the transmission gear 232 departs from the transmission gears 231 and 233. In this state, the driving force of the driving source M1 is not transmitted between the transmission gear 231 and the transmission gear 234.

When the detached sheet cassette 21 is attached to the cassette accommodation space 2A, the upper end part of the input part 210B contacts the lower surface of the sheet cassette 21, and moves downward while resisting the pressing force F2 of the pressing member 219. As a result, as shown in FIG. 7, the transmission gear 232 returns to the state where the transmission gear 232 engages with the transmission gears 231 and 233.

The components from the transmission gear 231 to the driving shafts 51S to 53S are defined as a transmission path for transmitting the driving force of the driving source M1 to the driving rollers 51A to 53A. The drive coupling mechanism 200 is constituted by the transmission gears 231 to 234, the driving shaft 53S, the rotation transmission unit 59 and the driving shafts 51S and 52S which form the transmission path, and the acting part 210 and the pressing member 210 which cause the transmission path to switch between the coupled state and the cut off state.

The printer according to the above described second embodiment is also able to achieve the same advantages as those of the first embodiment, According to the above described printer, by causing the transmission gear 232 to move along the plane S1 which is perpendicular to the driving shaft 53S, it is possible to downsize the printer in the device width direction in comparison with the printer 1 according to the first embodiment in which the coupling part 111 reciprocating in the left and right direction is employed.

Furthermore, according to the above described printer, by causing the acting part 210 to swing around the second swing axis X2 extending in the left and right direction which is parallel with the driving shaft 53S, the transmission gear 232 can be easily moved to reciprocate along the plane S1 which is perpendicular to the driving shaft 53S.

Although the present invention has been described in considerable detail with reference to certain preferred embodiments thereof, other embodiments are possible.

In the first embodiment, the coupling part 111A and the coupled part 111B are arranged coaxially with each other. However, the present invention is not limited to such a configuration. For example, the coupling part and the coupled part may be flat gearwheels, and a rotation axis of the coupling part may be shifted from a driving shaft of the coupled part.

A configuration in which the coupled part is a crown gear, the coupling part is a pinion gear rotatably fixed to the rotation shaft extending in the front and rear direction which is perpendicular to the driving shaft, and the crown gear and the pinion gear engage with each other or depart from each other through reciprocating motion in the front and rear direction of the rotation shaft is also included in the present invention.

What is claimed is:

1. An image forming device, comprising:

a device main body having a cassette accommodation space;

a sheet cassette accommodating a sheet-like medium, the sheet cassette being detachably attachable to the cassette accommodation space;

an image formation unit that is provided in the device main body and is configured to form an image on the sheet-like medium carried from the sheet cassette;

a re-carrying unit that is located under the sheet cassette attached to the cassette accommodation space in the device main body and is configured to re-carry the sheet-like medium to the image formation unit in a state where the sheet-like medium whose one face has been subjected to image formation has been reversed, the re-carrying unit being exposed to the cassette accommodation space when the sheet cassette is detached from the cassette accommodation space; and a driving source that is provided in the device main body and supplies a driving force to the re-carrying unit, wherein:

the re-carrying unit comprises a driving roller and a pinch roller that carry the reversed sheet-like medium by rotating and contacting with each other via the sheet-like medium;

a drive coupling mechanism having a transmission path transmitting the driving force of the driving source to the driving roller is provided between the driving source and the driving roller; and the drive coupling mechanism comprises an acting part that moves to bring the transmission path to a coupled state in accordance with an attaching motion of the sheet cassette to the cassette accommodation space without requiring movement of the re-carrying unit and moves to bring the transmission path to a cut off state in accordance with a detaching motion of the sheet cassette with respect to the cassette accommodation space.

2. The image forming device according to claim 1, wherein:

the drive coupling mechanism comprises a pressing member that produces a pressing force keeping the transmission path in the cut off state;

the acting part keeps the transmission path in the coupled state by contacting the sheet cassette attached to the cassette accommodation space and by moving while resisting the pressing force, and keeps the transmission path in the cut off state by departing from the sheet cassette detached from the cassette accommodation space and by moving while being pressed by the pressing force.

3. The image forming device according to claim 1, wherein:

the driving roller has a drive shaft extending, in a width direction, to one edge of the sheet-like medium being re-carried; and the drive coupling mechanism is arranged on a side of the one edge of the sheet-like medium and is coupled to the drive shaft.

4. The image forming device according to claim 3, wherein:

the drive coupling mechanism comprises a coupled part which is fixed to the side of the one edge of the drive shaft to rotate together with the drive shaft, and a coupling part which is provided to face the coupled part along a direction parallel with the drive shaft so as to cause a reciprocating motion in the direction parallel with the drive shaft in accordance with movement of the acting part;

the coupled part and the coupling part constitute a part of the transmission path; and the acting part brings the transmission path to the coupled state by coupling the coupling part to the coupled part, and brings the transmission path to the cut off state by causing the coupling part to depart from the coupled part.

5. The image forming device according to claim 4, wherein:

the coupled part and the coupling part are arranged coaxially with each other; and the coupled part and the coupling part engage with each other or depart from each other in accordance with the reciprocating motion.

6. The image forming device according to claim 4, wherein:

the acting part is supported in the device main body to be able to swing around a first swing axis extending in a direction perpendicular to the drive shaft; and the acting part causes the coupling part to produce the reciprocating motion in the direction parallel with the drive shaft by swing around the first swing axis to contact or depart from the sheet cassette when the sheet cassette is attached to or detached from the cassette accommodation space.

7. The image forming device according to claim 3, wherein the drive coupling mechanism comprises:

a first gear which is fixed to the side of the one edge of the drive shaft to rotate together with the drive shaft; and at least one intermediate gear which is rotatable around a rotation axis parallel with the drive shaft and is coupled to the first gear and the driving source along a plane perpendicular to the drive shaft, wherein:

the first gear and the at least one intermediate gear constitute a part of the transmission path; and the acting part brings the transmission path to the coupled state or the cut off state by causing the intermediate gear to produce a reciprocating motion along the plane perpendicular to the drive shaft and thereby causing the at least one intermediate gear to engage or depart from the first gear or another gear of the at least one intermediate gear.

8. The image forming device according to claim 7, wherein the acting part is supported in the device main body to be able to swing around a second swing axis extending in a direction parallel with the drive shaft;

the acting part causes the at least one intermediate gear to produce the reciprocating motion along the plane perpendicular to the drive shaft by contacting or departing from the sheet cassette and by rotating around the second swing axis when the sheet cassette is attached to or detached from the cassette accommodation space.

9. An image forming device, comprising:

a device main body having a cassette accommodation space;

a sheet cassette accommodating a sheet-like medium, the sheet cassette being detachably attachable to the cassette accommodation space;

an image formation unit that is provided in the device main body and is configured to form an image on the sheet-like medium carried from the sheet cassette;

a re-carrying unit that is located under the sheet cassette attached to the cassette accommodation space in the device main body and is configured to re-carry the sheet-like medium to the image formation unit in a state where the sheet-like medium whose one face has been subjected to image formation has been reversed, the re-carrying unit being exposed to the cassette accommodation space when the sheet cassette is detached from the cassette accommodation space; and a driving source that is provided in the device main body and supplies a driving force to the re-carrying unit, wherein:

the re-carrying unit comprises a driving roller and a pinch roller that carry the reversed sheet-like medium by rotating and contacting with each other via the sheet-like medium;

a drive coupling mechanism having a transmission path transmitting the driving force of the driving source to the driving roller is provided between the driving source and the driving roller; and the drive coupling mechanism comprises a contacting member movable between a first position at which the contacting member brings the transmission path to a coupled state and a second position at which the contacting member brings the transmission path to a cutoff state, the contacting member being configured to contact the sheet cassette when the sheet cassette is attached to the cassette accommodation space and be detached from the sheet cassette when the sheet cassette is removed from the cassette accommodation space, the contacting member being located at the first position when the contacting member contacts the sheet cassette and located at the second position when the contacting member does not contact the sheet cassette.

* * * * *